US011745832B2

(12) United States Patent
Canada et al.

(10) Patent No.: US 11,745,832 B2
(45) Date of Patent: Sep. 5, 2023

(54) STRINGER AND SYSTEM FOR MOUNTING EQUIPMENT TO A VESSEL'S HULL

(71) Applicant: TORX MARINE INC., Stuart, FL (US)

(72) Inventors: John Harley Canada, Stuart, FL (US); Rogerio Kovalski, West Palm Beach, FL (US); Vincent Nientimp, Stuart, FL (US)

( * ) Notice: Subject to any disclaimer, the term of this patent is extended or adjusted under 35 U.S.C. 154(b) by 243 days.

(21) Appl. No.: 17/337,616

(22) Filed: Jun. 3, 2021

(65) Prior Publication Data

US 2022/0144384 A1 May 12, 2022

Related U.S. Application Data

(60) Provisional application No. 63/110,496, filed on Nov. 6, 2020.

(51) Int. Cl.
*B63B 17/00* (2006.01)
*B63H 21/30* (2006.01)
*B63B 39/04* (2006.01)

(52) U.S. Cl.
CPC ..... *B63B 17/00* (2013.01); *B63B 39/04* (2013.01); *B63H 21/30* (2013.01)

(58) Field of Classification Search
CPC ..... B63B 17/00; B63B 39/04; B63B 5/24; B63B 21/30; B63B 2221/10; B63B 2231/52; B63B 3/28; B63B 3/34; B63B 2003/265; B63B 3/70
USPC ..... 114/364
See application file for complete search history.

(56) References Cited

U.S. PATENT DOCUMENTS

| | | | | |
|---|---|---|---|---|
| 4,365,580 | A | 12/1982 | Blount | |
| 4,778,420 | A | 10/1988 | Greenberg | |
| 6,047,659 | A * | 4/2000 | Schmidt, Jr. | B63B 23/32 114/369 |
| 6,386,131 | B1 | 5/2002 | Barsoum | |
| 9,365,266 | B2 * | 6/2016 | Liner | B63B 25/16 |
| 2020/0010159 | A1 | 1/2020 | Jennings | |

FOREIGN PATENT DOCUMENTS

| | | | |
|---|---|---|---|
| CA | 2815523 | A1 | 12/2013 |

* cited by examiner

*Primary Examiner* — Daniel V Venne
(74) *Attorney, Agent, or Firm* — Derek Fahey, Esq.; The IP Plus Firm, PLLC

(57) ABSTRACT

A system for mounting equipment to a vessel's hull is disclosed. The system comprises a first stringer and a second stringer, where each stringer is attachable to the inside of the vessel's hull. The system also includes a layer of adhesive attaching both stringers to the inside of the vessels hull. Both stringers have a top cap for attaching equipment. Additionally, each stringer has a first vertical side wall connected to a first end of the top cap, a second vertical side wall connected to a second end of the top cap, and two flanged portions. A first flanged portion connects to a lower end of the first vertical side wall, and a second flanged portion connects to a lower end of the second vertical side wall. The system has an open side portion at the bottom end of both stringers.

18 Claims, 9 Drawing Sheets

STRINGER AND SYSTEM FOR MOUNTING EQUIPMENT TO A VESSEL'S HULL

CROSS-REFERENCE TO RELATED APPLICATIONS

The present non-provisional application claims priority to provisional application 63/110,496, filed on Nov. 6, 2020, and entitled "STRINGER AND SYSTEM FOR MOUNTING EQUIPMENT TO A VESSEL'S HULL," the subject matter of which is hereby incorporated by reference in its entirety.

TECHNICAL FIELD

The present disclosure relates to the field of attaching equipment to a hull of a vessel, specifically water vessels.

BACKGROUND

Gyroscopic stabilization for vessels has become increasing popular among competitive sports fisherman and casual boaters. Generally, gyroscopes are added to vessels to diminish the rocking of the vessel along the roll axis caused by waves; thus, creating a more stable and enjoyable boating experience. The installation of a gyroscopic stabilizer to the hull of a vessel generally requires that a custom foundation be fabricated out of fiberglass or aluminum. The foundation then spreads the gyroscopic induced loads to the rest of the existing structure of the vessel.

To stabilize the vessel, the gyroscope spins aligned with the roll axis. As the gyroscope spins, the torque created by the spinning flywheel resists lateral movement such as the rocking and swaying of the vessel caused by the motion of waves and rough seas. The torque generated by the flywheel of the gyroscope requires the equipment to become an integral part of the boat and be tied or attached into the vessel's main stringers and strengthened areas. Therefore, retrofitting manufactured gyroscopic stabilizers to vessels is difficult. Usually, only the original builder or an experienced boatyard should install the equipment because they have the capability to integrate the mounting system for the equipment into the structure of the boat. In instances where mounting equipment, such as a gyroscopic stabilizer, is too difficult given the size of the vessel and the available area on the vessel, certain models of gyroscopes can be manufactured to the deck of the vessel. As a result, there exists a need for improvements over the prior art and more particularly for a more efficient way of mounting equipment to a vessel's hull.

SUMMARY

A system for mounting equipment to a vessel's hull is disclosed. As described in greater detail below, the system generally comprises a set of stringers, where each stringer is attached (e.g., adhered) to a hull of a vessel using adhesive, and where each stringer has a top cap for attaching equipment thereto. In another aspect, the structural and functional features of the stringers are disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a system for mounting equipment to a vessel's hull is disclosed. The system comprises a first stringer and a second stringer, where each stringer has a top cap for attaching equipment thereto, and a layer of adhesive for attaching each stringer to the inside of the vessel's hull. The first and second stringer each have a length. In some embodiments, the length of the first stringer and second stringer is identical. The first stringer is generally attachable to a first side inside the vessel's hull, and the second stringer is generally attachable to an opposing side inside the vessel's hull. Each stringer may have a unique design, the stringer design comprising a first vertical side wall connected to a first end of the top cap, a second vertical side wall connected to a second end of the top cap, a first flanged portion connected to a lower end of the first vertical side wall, a second flanged portion connected to a lower end of the second vertical side wall, and an open side portion at a bottom end of the first stringer and the second stringer. In some embodiments, the first flanged portion and the second flanged portion define a first plane that is at a flange angle of 10 to 35 degrees (e.g., 10 to 20 degrees, 15 degrees to 35 degrees) relative to a horizontal plane. In some embodiments, the first flanged portion and the second flanged portion define a first plane that is parallel to a deadrise plane of a hull of a vessel.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the disclosure and together with the description, serve to explain the principles of the disclosed embodiments. The embodiments illustrated herein are presently preferred, it being understood, however, that the disclosure is not limited to the precise arrangements and instrumentalities shown, wherein.

DETAILED DESCRIPTION

Figure 1A:
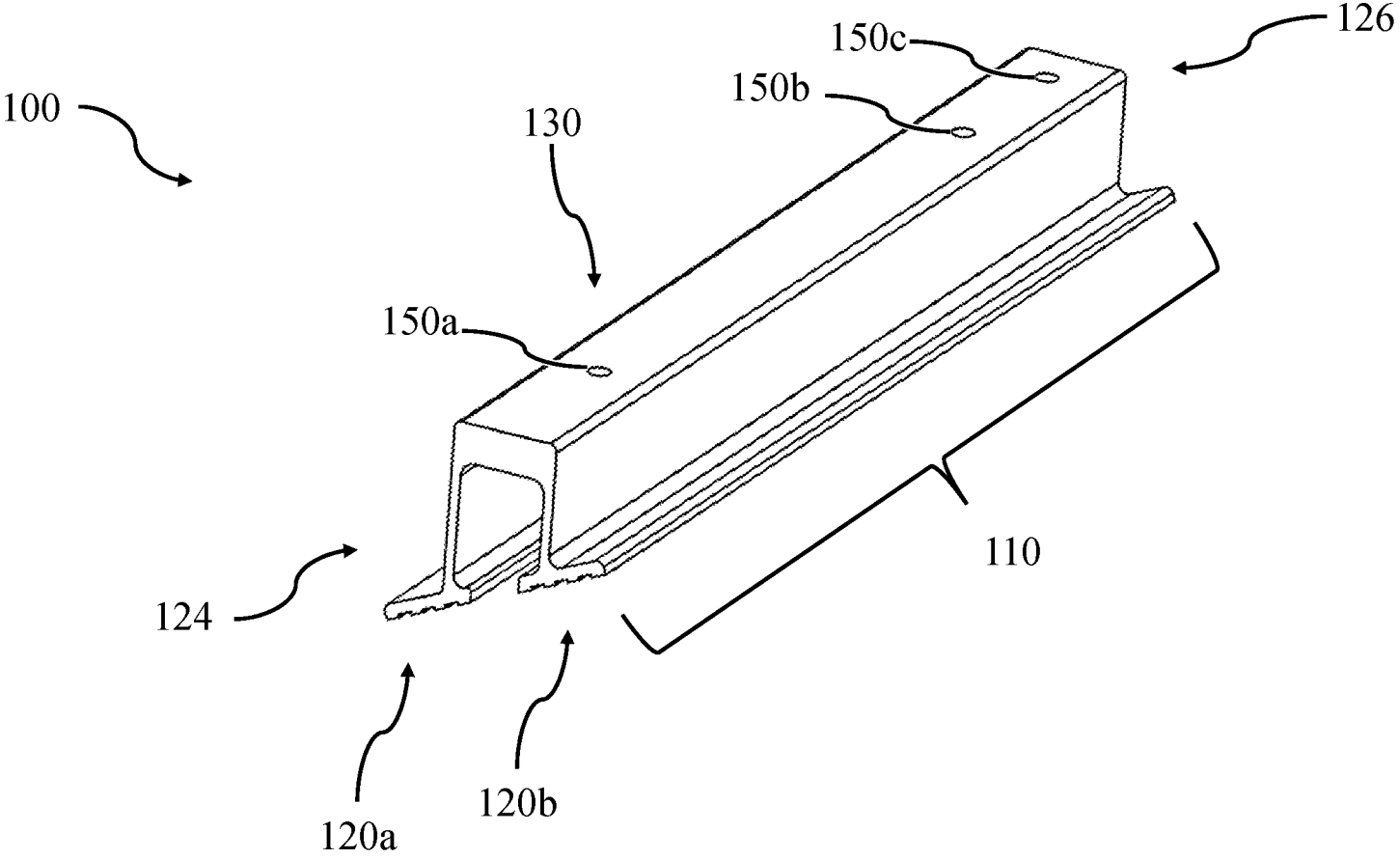
FIG. 1*a* is a perspective view of a stringer for attaching equipment to a vessel's hull, according to an example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions, or modifications may be made to the elements illustrated in the drawings, and the methods described herein may be modified by substituting reordering or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a system that allows for equipment (e.g., gyroscopic stabilizer(s)) to be easily attached to the hull of a vessel. The design of the stringers eliminates the need to produce specialized equipment that corresponds to the design of the particular vessel. Instead, the stringers included in the systems described herein allow for a more universal design for attaching equipment to a vessel's hull. Small variations in the design may allow for the stringers to be used in a wide variety of vessels. For instance, small variations in the flange angle and length of the stringers may allow for the stringers to be used in nearly all applicable vessels. The term, "stringer" refers to a structural member for use in vessels. Furthermore, the term, "vessels" also applies to vehicles other than water-based vehicles (e.g., boats, yachts, etc.). For instance, the disclosed stringers may be applicable to vessels such as aircraft (e.g., commercial aircraft), land-based vehicles such as trains or automotive vehicles, among others. Thus, the present invention may be broadly applicable to a variety of vessels.

i. System

Figure 3A:
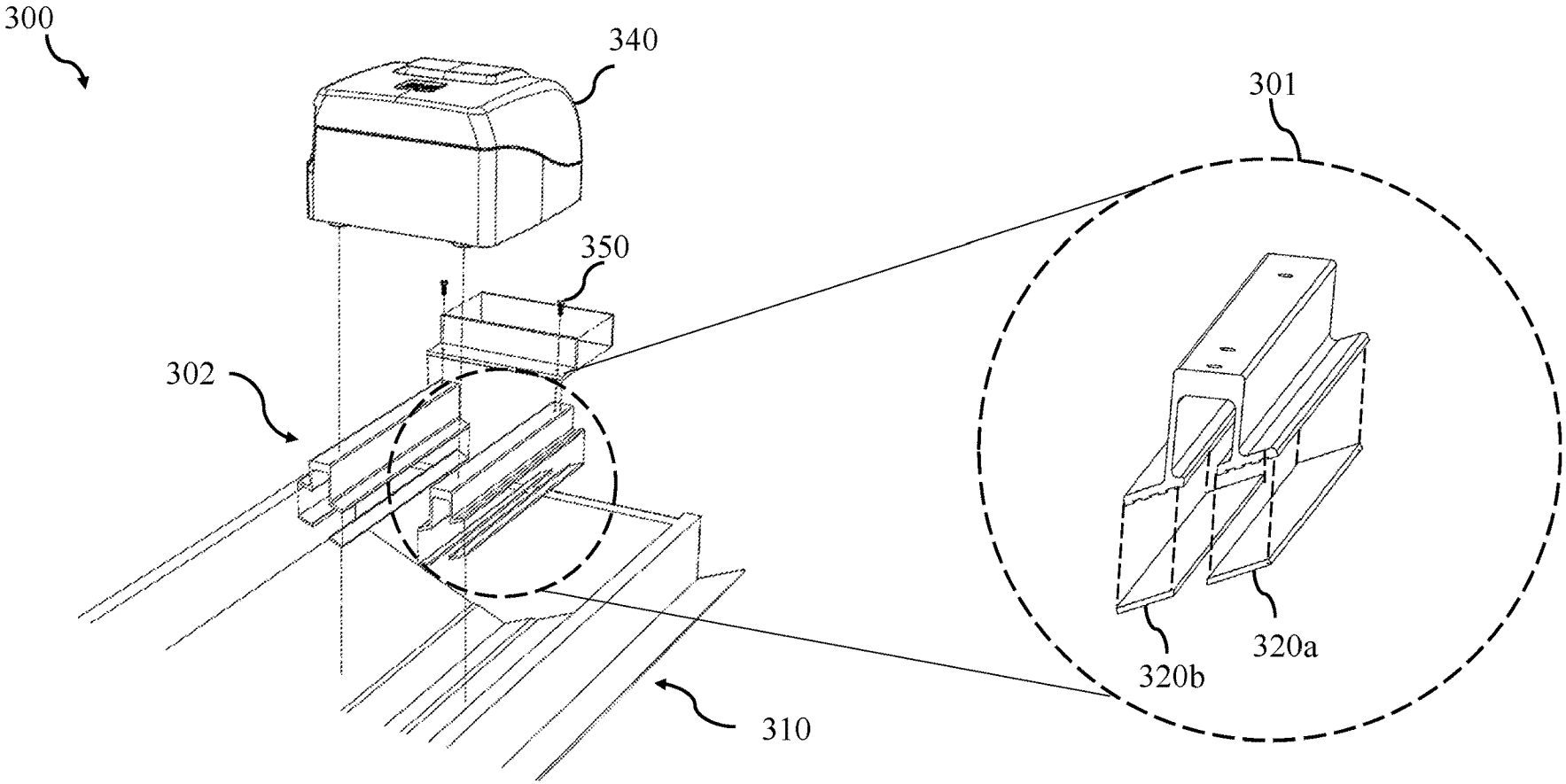
FIG. 3*a* is an exploded, perspective view of a system including a set of stringers, equipment, and a vessel.
Figure 3B:
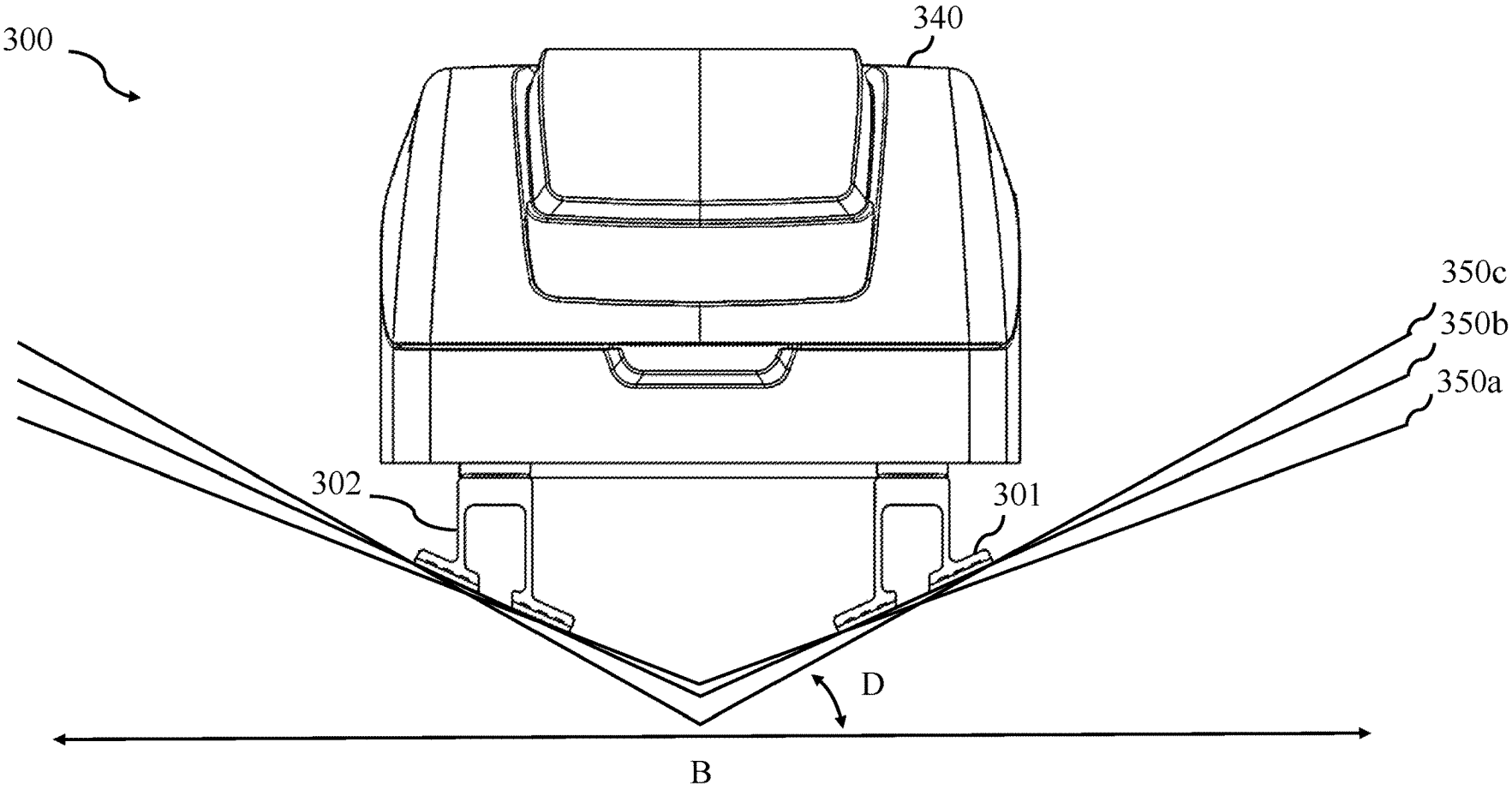
FIG. 3*b* is a front-side view of the system depicted in FIG. 3*a*, the figure illustrating the deadrise angle (line D)

Referring now to the Figures as a whole, a system 300 for mounting equipment to a vessel's hull 310 is shown (FIGS. 3*a*-3*b*). As illustrated, the system 300 comprises a first stringer having 301, a second stringer 302, and a layer of adhesive (120*a*-120*b* and 320*a*-320*b*). An exploded view of the first stringer 301 is shown in FIG. 3*a* that shows the adhesive 320*a*-320*b* separated from the stringer. Each stringer (301, 302) in the system 300 has a length 110 (e.g., a first length, a second length for each respective stringer), where the length may be defined by the terminals of a first end 124 to a second end 126. Each stringer (301, 302) is attachable to the inside of the vessel's hull 310. For instance, a first stringer 301 may be attached to a first side of the inside of the vessel's hull 310, and a second stringer 302 may similarly be attached to an opposing side of the vessel's hull 310. Each stringer (301, 302) may be attachable to the inside of the vessel's hull 310. For instance, the stringers (301, 302) may be attached to the hull 310 via a layer of adhesive 320*a*-320*b*, discussed in greater detail below.

Figure 1B:
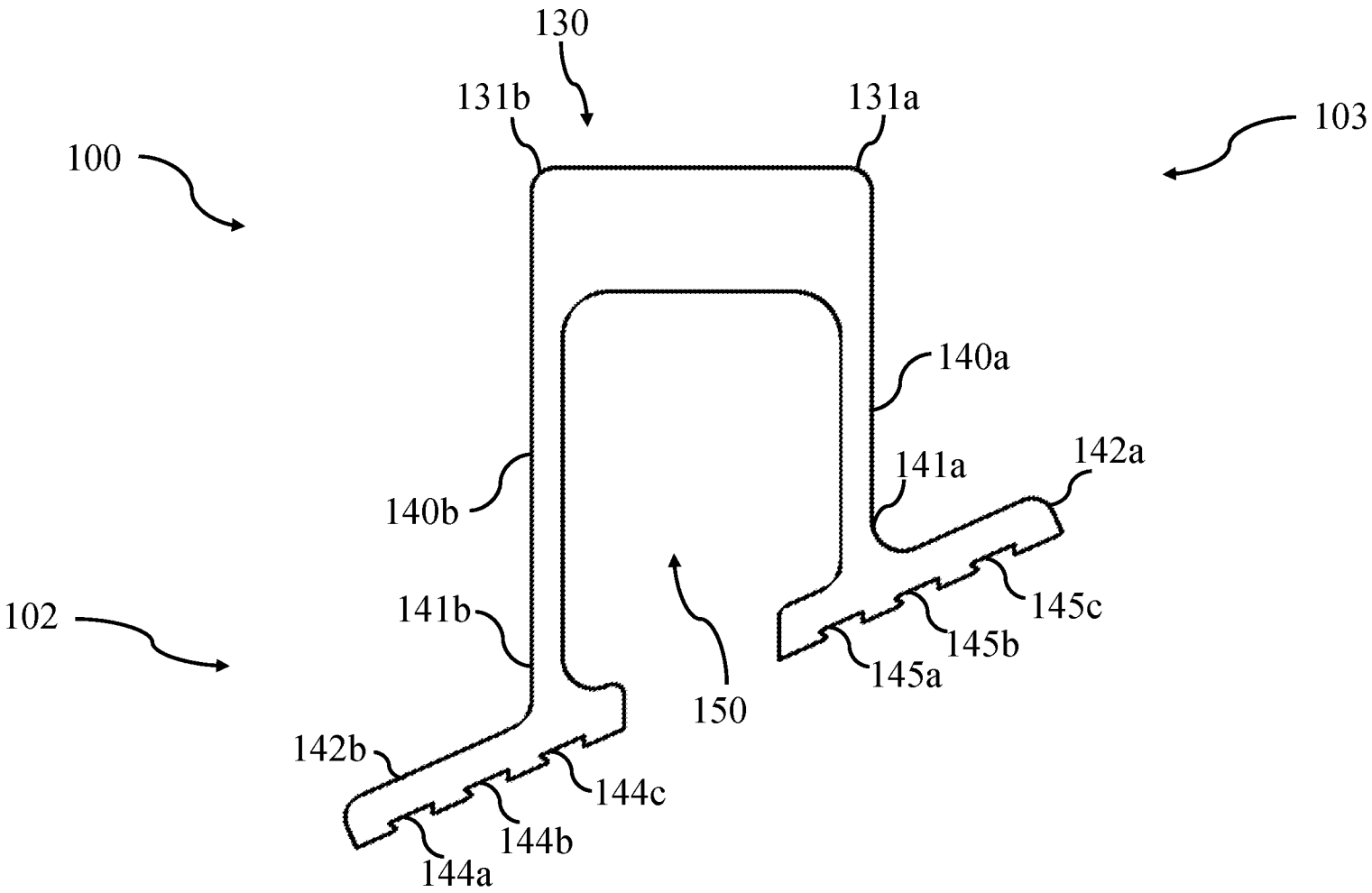
FIG. 1*b* is a cross sectional side view of a stringer for attaching equipment to a vessel's hull, according to an example embodiment.
Figure 1C:
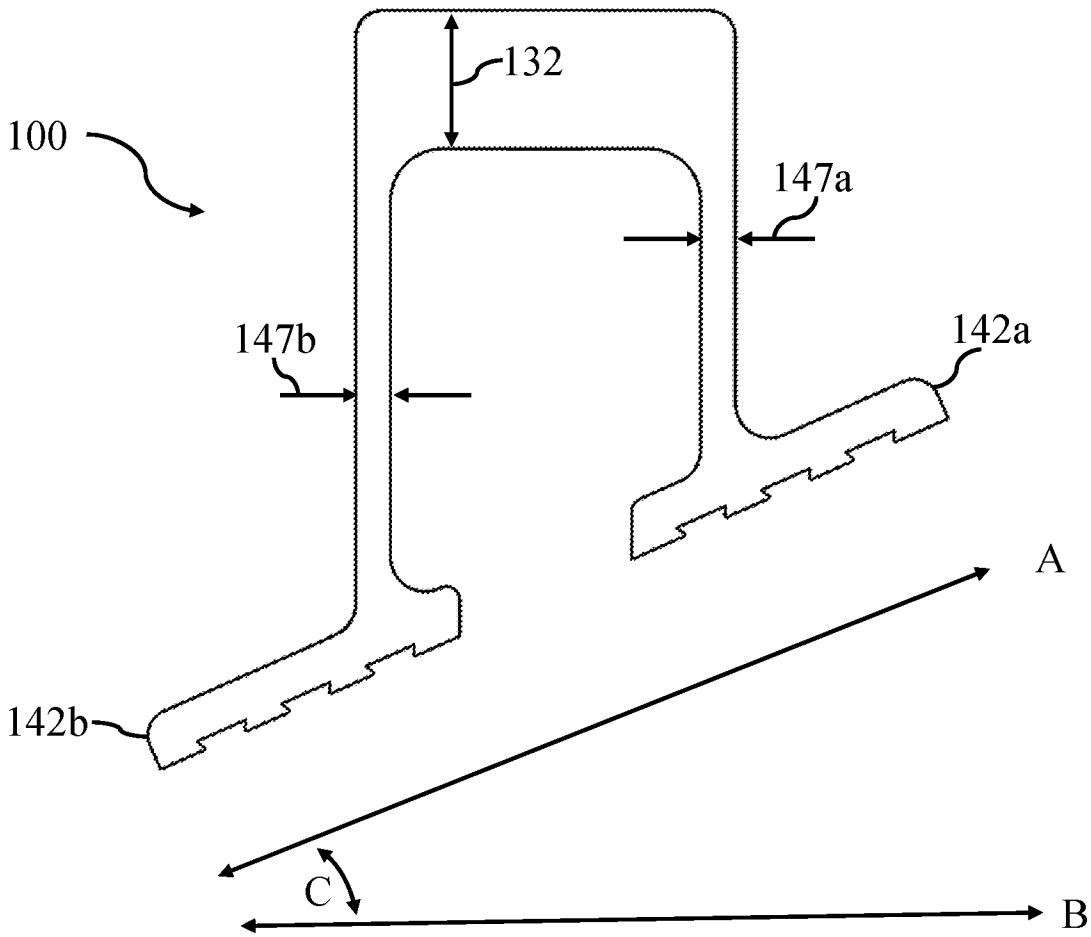
FIG. 1*c* is the cross-sectional side view of a stringer depicted in FIG. 1*b*, the figure illustrating the thicknesses and angles of the stringer.

The stringers (301, 302) each generally have a flange portion (142*a*, 142*b*) as shown in particular by FIGS. 1*b*-1*c*. The flange portions (142*a*, 142*b*) may define a plane (line A) that is at a flange angle (line C, FIG. 1*c*). The flange angle (line C) may be constant or varied from the first end 124 to the second end 126 of the stringer 110. For instance, the flange angle (line C) may correspond (e.g., be parallel) to the deadrise angle defined by a deadrise plane (350*a*-350*c*). The deadrise angle (line D, FIG. 3*b*) may vary from, for example, a first deadrise angle defined by a first deadrise plane 350*a* located at a first end 124 of the stringer, to a third deadrise angle defined by a third deadrise plane 350*c* at the second end 126 of the stringer 100. The second deadrise plane 350*b* may define a second deadrise angle, and the second deadrise angle may be of a value that is between the first deadrise angle and the third deadrise angle, and similarly located at a length between the first end 124 and second end 126.

The flanges may be angled that corresponds to the deadrise in a manner such that the top cap 130 of the stringer 100 is substantially parallel (e.g., within 5 degrees) to a horizontal plane. The horizontal plane may be, for instance, the deck of the vessel.

The deadrise angle (line D) may be constant for certain vessels, whereas other vessels may have a varied deadrise angle. Nonetheless, the present invention allows for each respective flange to be angled such that it corresponds to the deadrise angle of the hull 310 of a vessel. For instance, in some embodiments, the flange angle and/or deadrise angle varies from 10 degrees to 35 degrees. In one embodiment, the flange angle and/or deadrise angle is from 10 degrees to 20 degrees. In another embodiment, the flange angle and/or deadrise angle is from 15 degrees to 35 degrees. In some embodiments, the flange angle and/or deadrise angle is relatively constant (e.g., less than 5% variation in the absolute angle) and between 20 degrees and 28 degrees. In some embodiments, the flange angle and/or deadrise angle is relatively constant (e.g., less than 5% variation in the absolute angle) and is about 24 degrees. The term "about" may mean less than 5% variation in the absolute value of the recited measurement.

In such embodiments where the flange angle varies along the length of the stringer, a portion of the length of the stringer may have a flange angle configured to fit a certain deadrise angle portion and a second portion of the length of the stringer may have a second flange angle configured to fit a different deadrise angle. These embodiments are configured to allow for the stringers to be attached to a variety of different positions within the hull of vessel. It is understood that the present embodiment also includes the methods for producing the stringers having varying flange angles along the body of the stringer. Stringers having varying flange angles along the length of the stringer also increase the number of vessels types, lengths, manufactures that may be accommodated with the stringer and system invention disclosed herein.

The stringers (301, 302) generally comprise a top cap 130 for attaching the equipment 340 thereto. The top cap 130 may be used to (e.g., configured for) receiving fasteners 350 for attaching the equipment 340 to the top cap 130 of each stringer (301, 302). For instance, equipment 340 is illustrated as being bolted to the first and second stringers (301, 302). Accordingly, the stringer 100 may include a plurality of fastener receiving sections 150*a*-150*c*, such as holes for receiving bolts.

The equipment 340 may comprise at least one of a gyroscopic stabilizer, a generator, an engine, a tank, a battery, and a pump. In one embodiment, the equipment 340 comprises a gyroscopic stabilizer. The gyroscopic stabilizer may be used to steady the motion of the vessel's hull 310. In this way, the gyroscopic stabilizer may diminish the rocking of the vessel along the roll axis caused by waves, thus creating a more stable and enjoyable boating experience.

The stringers may be produced from various materials, such as metals and metal alloys, plastics (e.g., reinforced plastics), among other suitable materials. In one embodiment, each of the stringers are comprised of (or consist of) at least one of extruded aluminum and pultruded fiberglass.

In some embodiments, the stringers comprise (e.g., consist of) an aluminum alloy. In one embodiment, the stringers are made of a 6XXX series aluminum alloy. The term, "6XXX aluminum alloy" refers to an aluminum alloy having copper and magnesium as the primary alloying elements, other than aluminum. In one embodiment, the stringers are made of a 6061-aluminum alloy. A stringer comprising or consisting of a metal or metal alloy may be produced by any suitable fashion, for instance, by casting (e.g., produced via any type of suitable mold), extrusion, additive manufacturing, and forging.

In some embodiments, the stringers comprise (e.g., consist of) a fiberglass. The stringers may be produced with the fiberglass utilizing any suitable method, such as pultrusion.

Figure 5:
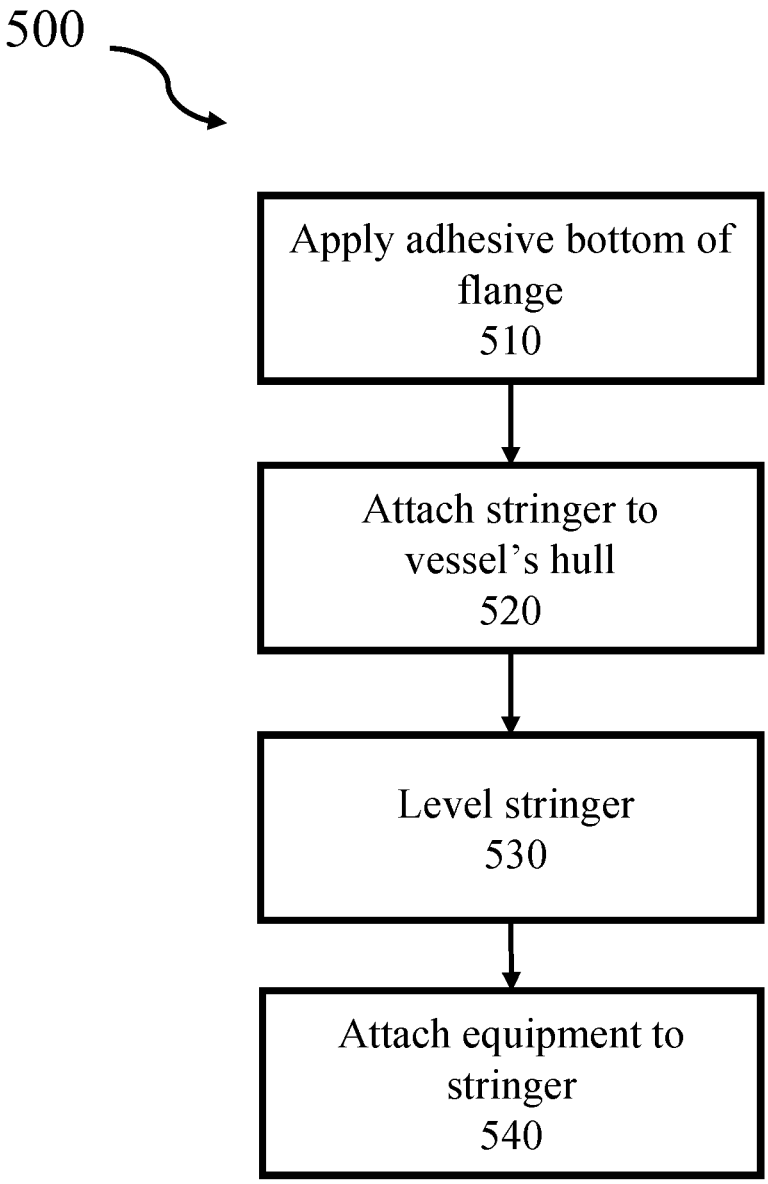
FIG. 5 is a block-flow diagram of a method for mounting equipment to a vessel's hull.

As noted above, each stringer (301, 302) may be attachable using a layer of adhesive (320*a*, 320*b*). In this way, each stringer (301, 302) may be secured to the vessel's hull 310 by applying the adhesive to the bottom surface of each stringer (e.g., a bottom surface of a flanged portion) and attaching the adhesive-laden stringer to the vessel's hull. The adhesive (320*a*, 320*b*) may require a curing period to maximize the physical bond formed between the stringer (301, 302) and the vessel's hull 310. A block-flow diagram 500 of such a method is shown in FIG. 5. As illustrated, the method generally comprises applying adhesive to bottom of at least one flange 510, attaching the stringer to the vessel's hull 520, leveling the stringer 530, and lastly attaching equipment to the stringer(s) 540. In a more particular embodiment, a method for mounting equipment to a vessel's hull comprises (a) applying adhesive to a bottom surface of a flanged portion of a stringer, (b) attaching the stringer to the vessel's hull, (c) leveling the stringer such that a top cap of the stringer is parallel to a horizontal plane, and (d) attaching equipment to the top cap of the stringer.

Figure 4:
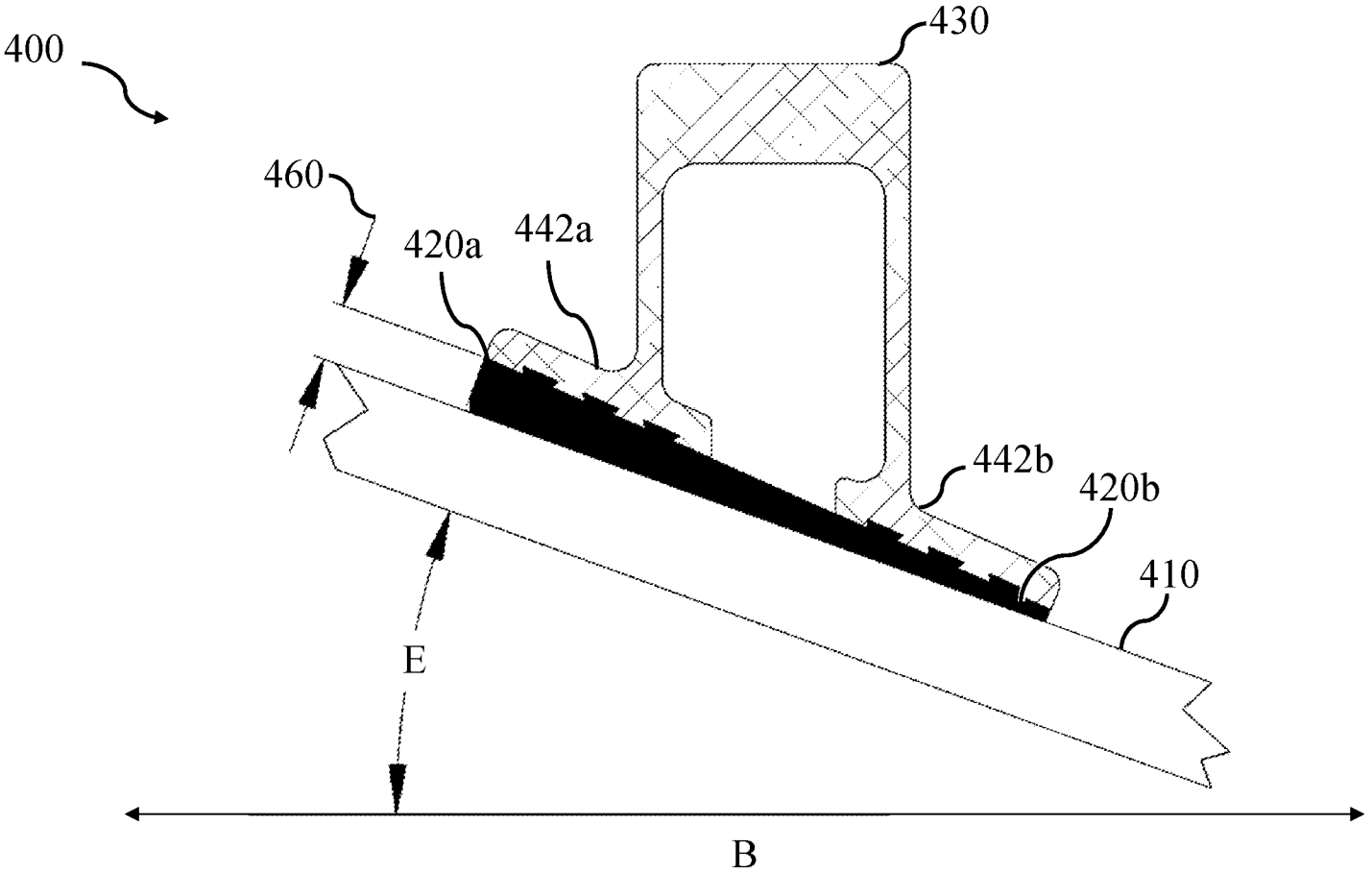
FIG. 4 is a cross-sectional side view of a stringer adhered to a hull via an adhesive, the figure illustrating the adhesive thickness resulting from the variance of the flange angle with relation to the deadrise angle of the vessel.

In some embodiments, the adhesive (320*a*, 320*b*) has an adhesive thickness that is between a minimum allowable adhesive thickness and a maximum allowable adhesive thickness. The adhesive thickness may vary between the minimum and maximum allowable thicknesses to maintain structural properties of the adhesive (320*a*, 320*b*). The adhesive thickness may vary along the flange portion(s) (142*a*, 142*b*) to maintain sufficient bonding area. For instance, and reference to the figures now including FIG. 4, a cross-sectional side view of the system 400 illustrating the adhesive thickness (460) resulting from the variance of the flange angle (line C of FIG. 1*c*) with relation to the deadrise angle (line E) of the vessel is shown. The deadrise angle (line E) may vary along the length of the vessel's hull 410. In one embodiment, the flange angle (line C of FIG. 1*c*) is not parallel to the deadrise angle (line E), the adhesive thickness 460 varies between the maximum adhesive thickness 420*a* and the minimum adhesive thickness 420*b* such that the flange angle (line C of FIG. 1*c*) is effectively parallel to the deadrise angle (line E). In the example embodiment of FIG. 4, the adhesive thickness 460 has a maximum adhesive thickness 420*a* at flanged portion first end 442*a* of the flanged portion and a minimum adhesive thickness 420*b* at flanged portion second end 442*b*. In one embodiment (not illustrated), the adhesive thickness has a minimum adhesive thickness at flanged portion first end of the flanged portion and a maximum adhesive thickness at flanged portion second end. The adhesive thickness 460 may vary between a maximum adhesive thickness 420*a* and a minimum adhesive thickness 420*b* such that the top cap 430 is parallel to the horizontal plane (line B).

As illustrated in FIG. 3*a*, an exploded view of the system 300 is shown. The exploded view of the system 300 includes both stringers 301, 302 and each stringer has a layer of adhesive (320*a*, 320*b*). The adhesive may comprise any suitable adhesive for adhering the stringers (301, 302) to the inside of the vessel's hull 310. For instance, in one embodiment, the adhesive (320*a*, 320*b*) comprises a methacrylate structural adhesive.

ii. Stringer Design

Figure 1D:
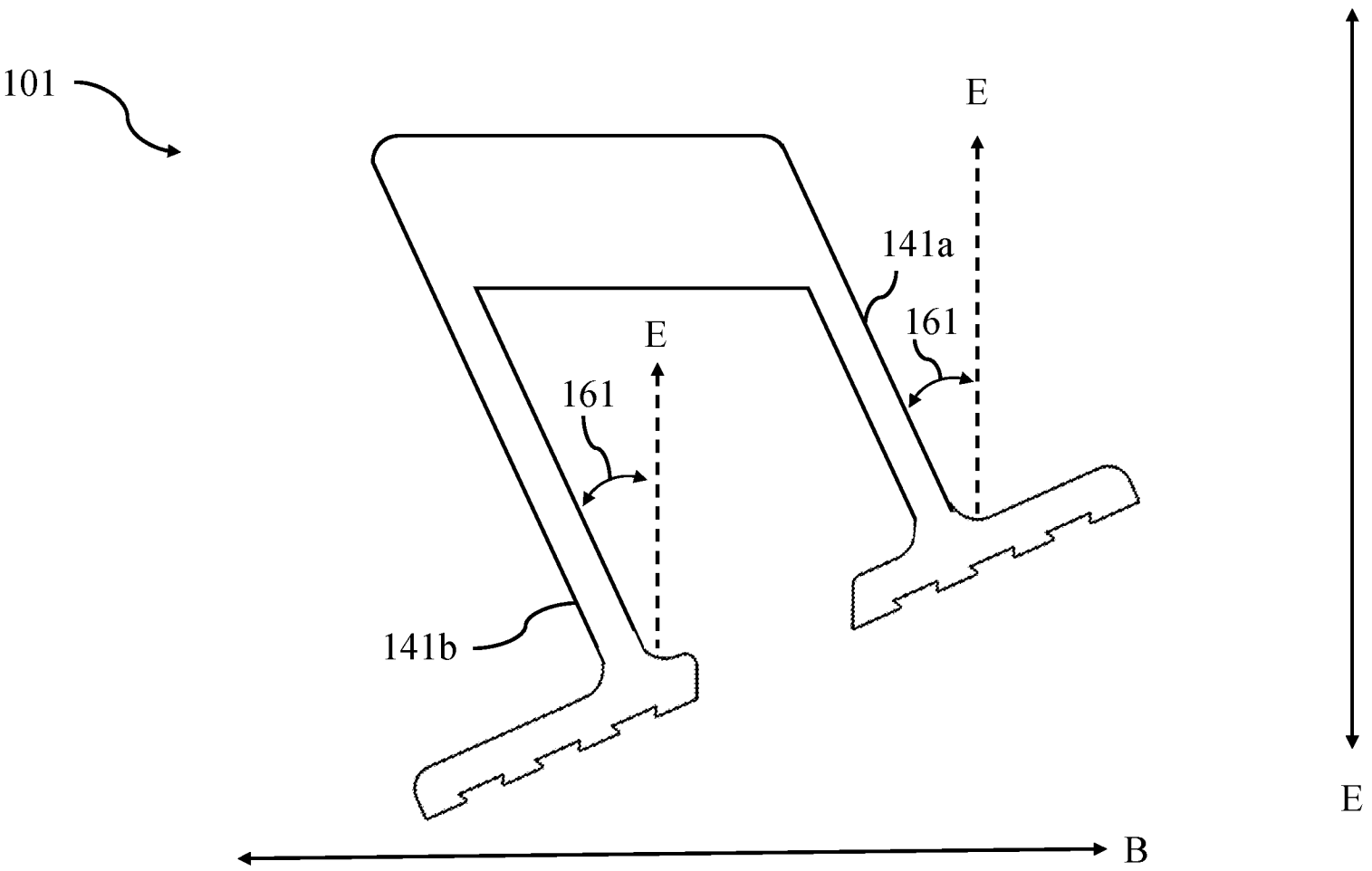
FIG. 1*d* is the cross-sectional side view of a stringer having angled side walls, according to an example embodiment.
Figure 2:
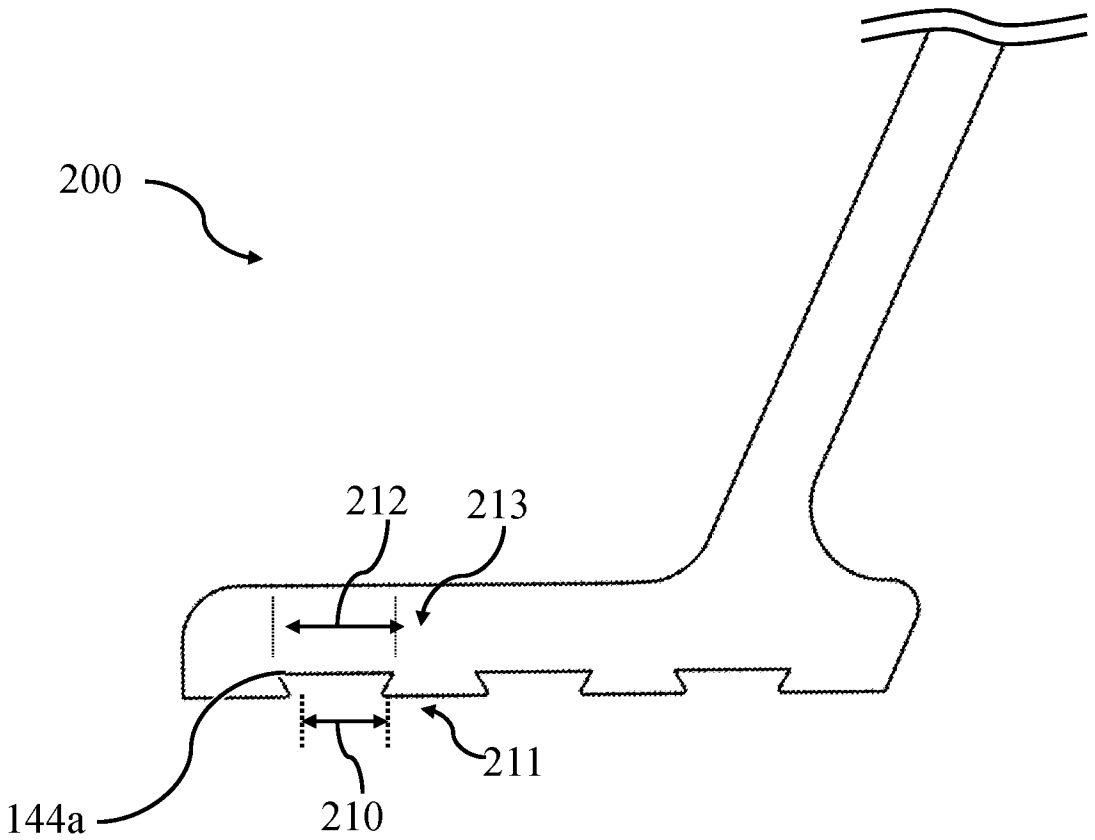
FIG. 2 is a zoomed-in, cross sectional side view, of the stringer depicted in FIG. 1*b*-1*c*, the figure illustrating the flange portion having a plurality of grooves.

Referring now specifically to FIGS. 1*a*-2, a particular design for a stringer according to an example embodiment is shown. FIG. 1*a* shows a perspective view of the stringer 100, whereas FIGS. 1*b*-2 show a front-side view of the stringer 100, 200. As illustrated in FIG. 1*a*, the stringer 100 has a particular length 110 and includes a top cap 130, a first end 124, a second end 126, and adhesive (120*a*, 120*b*) adhered to each flange portion (142*a*, 142*b*). The stringer 100 has a top portion 103 and a bottom portion 102. Equipment is generally attached to the top portion 103 using the top cap 130. In embodiments, the length 110 of a first stringer and second stringer are substantially the same (e.g., less than 5% variation in the lengths).

With particular reference now to FIGS. 1*b* and 1*c*, the stringer 100 includes a first vertical side wall 140*a* connected to a first end 131*a* of the top cap and a second vertical side wall 140*b* connected to a second end 131*b* of the top cap. The top cap 130 may have a first thickness 132, the first vertical side wall 140*a* may be of a second thickness 147*a*, and the second vertical side wall 140*b* may be of a third thickness 147*b*. Generally, the top cap thickness 132 is greater than that of the first and/or second vertical side wall thicknesses (147*a*, 147*b*). The vertical wall sides (140*a*, 140*b*), top cap 130, and flanges (142*a*, 142*b*) may define an open side portion 150 at a bottom end of each stringer (301, 302).

The stringer 100 also includes a first flanged portion 142*a* connected to a lower end of the first vertical side wall 141*a* and a second flanged portion 142*b* connected to a lower end of the second vertical side wall 141*b*. The flanged portions (142*a*, 142*b*) generally define a flange angle (line C) where the flange angle is defined by the plane defined by the flanged portions (line A) and the horizontal plane (line B). As noted above and with reference to the figures momentarily including FIGS. 3*a*-3*b*, the vessel's hull 310 may have a deadrise angle (line D). The deadrise angle (line D) may vary along the length of the vessel's hull 310, and the flange angle of each stringer may correspondingly vary along the length 110 of the stringer. For instance, the flange angle (line C) may be parallel to the deadrise angle (line D).

With reference momentarily to FIG. 1*d*, an embodiment of a stringer 101 where the side walls (141*a*, 141*b*) have a second angle is shown. As illustrated, the side walls (141*a*, 141*b*) have an angle relative to the vertical plane (line E). The vertical plane (line E) is orthogonal to the horizontal plane (line B). The second angle 161 may similar vary relative to the vertical plane, and the variations may correspond to a change in the deadrise angle of a hull of a vessel. Thus, in another embodiment, at least one of the first vertical side wall 141*a* and the second vertical side wall 141*b* have a second angle that varies relative to a vertical plane, wherein the second angle corresponds to a dead-rise angle of the vessel's hull.

With reference now specifically to FIGS. 1*b* and 2, each stringer may have at least two flanged portions (142*a*, 142*b*), and the flanged portions (142*a*, 142*b*) may comprise a bottom surface having at least one groove. For instance, as shown, the flanged portions include a plurality of grooves (144*a*-144*c*, 145*a*-145*c*), specifically three groves on each flanged portion (142*a*, 142*b*). The grooves (144*a*-144*c*, 145*a*-145*c*) may receive the adhesive and may strengthen the physical bond formed between the vessel's hull and the stringer. Each groove may have a particular shape and design. For instance, a bottom portion of a stringer 200 is shown in FIG. 2. FIG. 2 is a zoomed-in, front-side view, of the stringer depicted in FIG. 1*b*-1*c*. As illustrated, groove 144*a* has a first cross-sectional length 210 at an outward end of the groove 211 that is smaller than a second cross-sectional length 212 at an inward end of the groove 213. The term "smaller" may be applicable if the difference between the first length and second length is greater than a 5% absolute difference.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

We claim:

1. A system for mounting equipment to a vessel's hull, wherein the system comprises:

a first stringer having a first length attachable to a first side inside the vessel's hull;

a second stringer having a second length attachable to an opposing side inside the vessel's hull;

a layer of adhesive for attaching each of the first stringer and the second stringer to an inside of the vessel's hull;

wherein each of the first stringer and the second stringer have a top cap for attaching the equipment thereto;

wherein each of the first stringer and the second stringer comprise a first vertical side wall connected to a first end of the top cap;

a second vertical side wall connected to a second end of the top cap;

a first flanged portion connected to a lower end of the first vertical side wall;

a second flanged portion connected to a lower end of the second vertical side wall;

an open side portion at a bottom end of the first stringer and the second stringer;

wherein the first flanged portion and the second flanged portion define a first plane that is at a flange angle of 10 degrees to 35 degrees relative to a horizontal plane.

2. The system of claim 1, wherein the flange angle is 24 degrees.

3. The system of claim 2, wherein a bottom surface of each flanged portion defines at least one groove for receiving adhesive.

4. The system of claim 3, wherein each at least one groove has a first cross-sectional length at an outward end of the at least one groove that is smaller than a second cross-sectional length at an inward end of the at least one groove.

5. The system of claim 3, wherein the top cap of each stringer has a first thickness that is greater than a second thickness of the first vertical side wall and a third thickness of the second vertical side wall.

6. The system of claim 1, wherein the top cap is configured for receiving fasteners for attaching the equipment to the top cap of each stringer.

7. The system of claim 1, wherein the layer of adhesive for securing each stringer to the vessel's hull is a methacrylate structural adhesive.

8. The system of claim 1, where the equipment comprises at east one of a gyroscopic stabilizer, a generator, an engine, a tank, a battery, and a pump.

9. The system of claim 1, wherein each of the first stringer and the second stringer are at least one of extruded aluminum or pultruded fiberglass.

10. The system of claim 1, wherein the flange angle varies relative to the horizontal plane along the first length and the second length of each respective stringer.

11. The system of claim 1, wherein the system is configured to attach to the vessel's hull having a deadrise angle of between ten (10) degrees and thirty-five (35) degrees.

12. The system of claim 1, wherein the first flanged portion and the second flanged portion define the first plane that is parallel to a deadrise plane of a hull of a vessel.

13. The system of claim 7 wherein the layer of adhesive comprises an adhesive thickness, where the adhesive thickness varies between a minimum adhesive thickness and a maximum adhesive thickness.

14. A first stringer and a second stringer for mounting equipment to a vessel's hull, wherein each stringer comprises:

a first length attachable to a first side of the vessel's hull;

a top cap for attaching the equipment thereto;

a first vertical side wall connected to a first end of the top cap;

a second vertical side wall connected to a second end of the top cap;

a first flanged portion connected to a lower end of the first vertical side wall;

a second flanged portion connected to a lower end of the second vertical side wall;

an open side portion at a bottom end of the first stringer and the second stringer; and wherein the first flanged portion and the second flanged portion define a first plane having a flange angle relative to a horizontal plane.

15. The first stringer and the second stringer of claim 14, wherein each of the first stringer and the second stringer are configured to attach to the vessel's hull having a deadrise angle of between ten (10) degrees and thirty-five (35) degrees.

16. The first stringer and the second stringer of claim 15, wherein the flange angle is between ten (10) degrees and thirty-five (35) degrees relative to the horizontal plane.

17. The first stringer and the second stringer of claim 16, wherein the first flanged portion defining the first plane is parallel to a deadrise plane of the vessel's hull such that the flange angle and the deadrise angle are parallel.

18. The first stringer and the second stringer of claim 14, wherein at least one of the first vertical side wall and the second vertical side wall have a second angle that varies relative to a vertical plane, wherein the second angle corresponds to a dead-rise angle of the vessel's hull.

* * * * *